US008381558B2

(12) United States Patent
Alef

(10) Patent No.: US 8,381,558 B2
(45) Date of Patent: Feb. 26, 2013

(54) INSTITUTIONAL DOOR LOCK AND RETROFIT MECHANISM

(76) Inventor: Peter Alef, Portland, OR (US)

( * ) Notice: Subject to any disclaimer, the term of this patent is extended or adjusted under 35 U.S.C. 154(b) by 705 days.

(21) Appl. No.: 12/080,740

(22) Filed: Apr. 3, 2008

(65) Prior Publication Data

US 2008/0289377 A1 Nov. 27, 2008

Related U.S. Application Data

(60) Provisional application No. 60/931,181, filed on May 21, 2007.

(51) Int. Cl.
*E05B 47/00* (2006.01)

(52) U.S. Cl. ..... 70/280; 70/101; 70/141; 70/450

(58) Field of Classification Search ..... 70/101, 70/102, 106, 141, 282, 432, 450, DIG. 16, 70/280; 16/412
See application file for complete search history.

(56) References Cited

U.S. PATENT DOCUMENTS 3,408,838 A * 11/1968 Katz ..... 70/277
3,605,459 A * 9/1971 Van Dalen ..... 292/144
3,673,605 A * 6/1972 Allenbaugh ..... 70/451
4,180,287 A * 12/1979 Youngblood et al. ..... 292/144
4,415,191 A * 11/1983 Thorp ..... 292/346
4,484,463 A * 11/1984 Hennessy ..... 70/452
4,593,543 A * 6/1986 Stefanek ..... 70/134
4,663,950 A * 5/1987 Mascotte ..... 70/416
4,904,005 A * 2/1990 Frolov ..... 292/144
4,929,003 A * 5/1990 McConnell ..... 292/144
5,040,393 A * 8/1991 Rossebo ..... 70/450
5,131,189 A * 7/1992 Mascotte ..... 70/417
5,406,814 A * 4/1995 Zeager et al. ..... 70/417
5,556,140 A * 9/1996 Sakagami ..... 292/92
5,603,194 A * 2/1997 Fridlyand et al. ..... 70/450
5,686,899 A * 11/1997 Hosmer ..... 70/278.1
5,729,198 A * 3/1998 Gorman ..... 70/279.1
5,850,753 A * 12/1998 Varma ..... 70/278.7
5,865,483 A * 2/1999 Dubravin ..... 70/277
6,035,676 A * 3/2000 Hudspeth ..... 70/278.1
6,318,138 B1 * 11/2001 Mathews et al. ..... 70/278.7
6,580,355 B1 * 6/2003 Milo ..... 70/280
6,581,333 B2 * 6/2003 Kimball ..... 49/504
6,601,418 B2 * 8/2003 Huang ..... 70/280
6,679,004 B1 1/2004 Olberding et al.
7,010,947 B2 * 3/2006 Milo ..... 70/257
7,048,312 B2 * 5/2006 Brunner ..... 292/163

(Continued)

OTHER PUBLICATIONS

The Door Company—Glossary of Terms (pages from web site); thedoorcompany.net (2000) (3 pages).

(Continued)

*Primary Examiner* — Christopher Boswell
(74) *Attorney, Agent, or Firm* — Ater Wynne LLP

(57) ABSTRACT

An institutional door lock mechanism for retrofitting existing installations with a remotely controllable/monitorable door lock and open/close position indicator is described. A hollow vertical door strike jamb extends along an outside surface of the door frame opposite a hollow vertical columnar striker plate mechanism mounted on a fronting plate of the door. A hollow vertical housing also on the fronting plate contains a first component part of a proximity/alignment detection mechanism including a magnetic reed switch. The door strike jamb is configured as a vertical riser for housing a wiring harness for the catch-extension/retraction mechanism and for the proximity/alignment detection mechanism. The catch-extension/retraction mechanism includes a motor for extending/retracting the catch, the motor being operable by a securely coded manual key placed adjacent a switch mechanism or within a keyway operatively coupled with the switch mechanism. The catch-extension/retraction mechanism operates in a fail-safe lock-down mode of operation in the event of power interruption or failure.

19 Claims, 3 Drawing Sheets

U.S. PATENT DOCUMENTS

| | | | | |
|---|---|---|---|---|
| 7,121,531 | B1 * | 10/2006 | Gonzalez | 70/416 |
| 7,128,350 | B2 * | 10/2006 | Eckerdt | 70/277 |
| 7,144,053 | B2 * | 12/2006 | Bashford | 292/341.16 |

OTHER PUBLICATIONS

Builders Door Outlet—Door Definitions (pages from web site); buildersdooroutlet.com/definitions.htm; (2006) (2 pages).

Doors for Builders, Inc.—Terminology—Wood Entry Doors (pages from web site); www.doorsforbuilders.com/terminology.html (2006-2010) (2 pages).

GREATDOORBUYS.COM—Terminology; (pages from web site) greatdoorbuys.com/terminology.php (2 pages).

Hardware Source;—Spring Hinges-Double Acting Hinges; hardwaresource.com/hinges/DOOR+HINGES/Spring+Hinges+-+Double_Acting_Hinges (pages from web site); (2002-2010) (page).

Builders Lock and Hardware—Glossary of Terms; (pages from web site) builderslock.com/glossary-of-terms-a9.html (2007) (2 pages).

* cited by examiner

INSTITUTIONAL DOOR LOCK AND RETROFIT MECHANISM

RELATED APPLICATIONS

This application claims the benefit of priority to U.S. Provisional Patent Application Ser. No. 60/931,181, filed on 21 May 2007 and entitled. INSTITUTIONAL DOOR LOCK MECHANISM, the contents of which are hereby incorporated herein in their entirety by this reference.

BACKGROUND OF THE INVENTION

This invention relates generally to the field of access and security. More particularly, it concerns a unique, retrofit-able door locking assembly for institutional use.

Thousands of lock-down facilities across the country are equipped with manual key locks on doors for access to and from secure areas, e.g. prison and/or jail cells or blocks. Security, safety and cost concerns have driven regulations regarding more modern locking systems that are remotely operable, e.g. from a guard station, and manually operable with a key, e.g. by a guard or jailer. Remote door-position monitoring is desirable in such institutional settings to ensure that every door is in its proper open or closed position at all times for both security and safety concerns of both inmates and staff.

DETAILED DESCRIPTION OF THE PREFERRED EMBODIMENTS

The invention in accordance with a preferred embodiment involves a hollow, auxiliary door strike jamb, a door-mounted plate and a lock mechanism operable to securely couple the door to the auxiliary door strike jamb. The auxiliary door strike jamb is securely and unyieldably secured, as by welding, to an existing, typically institutional, door jamb (e.g. to a jail or prison cell), with the weld seams preferably finished with auto body filler, sanded smooth and painted. The unique structure of the auxiliary door strike jamb and the door-mounted plate fixed with a pull handle enables easy retrofitting of an electromechanical door lock and door position indicator (DPS) mechanism for securely, selectively operating and monitoring a conventional sliding bolt-type lock and associated door. The auxiliary door strike jamb's hollow interior (which door strike jamb may be referred to herein as a "riser") provides an electrical conduit to accommodate a wiring harness for the required electrical connections.

There are many suitable manufacturers of the electromechanical components that form a part of the invention. For example, the DPS mechanism is available from a variety of sources and the magnetic reed switch that forms a part thereof is available from DETEX (e.g. model MS-2049F or alternative) in a twenty-four volt direct current (24VDC) version. The electromechanical lock is available from Folger Southern, Brinks, and Airteq. Those of skill in the art will appreciate that any suitable electromechanical devices can be used that accomplish the security and monitoring functions provided by the invention.

Figure 1:
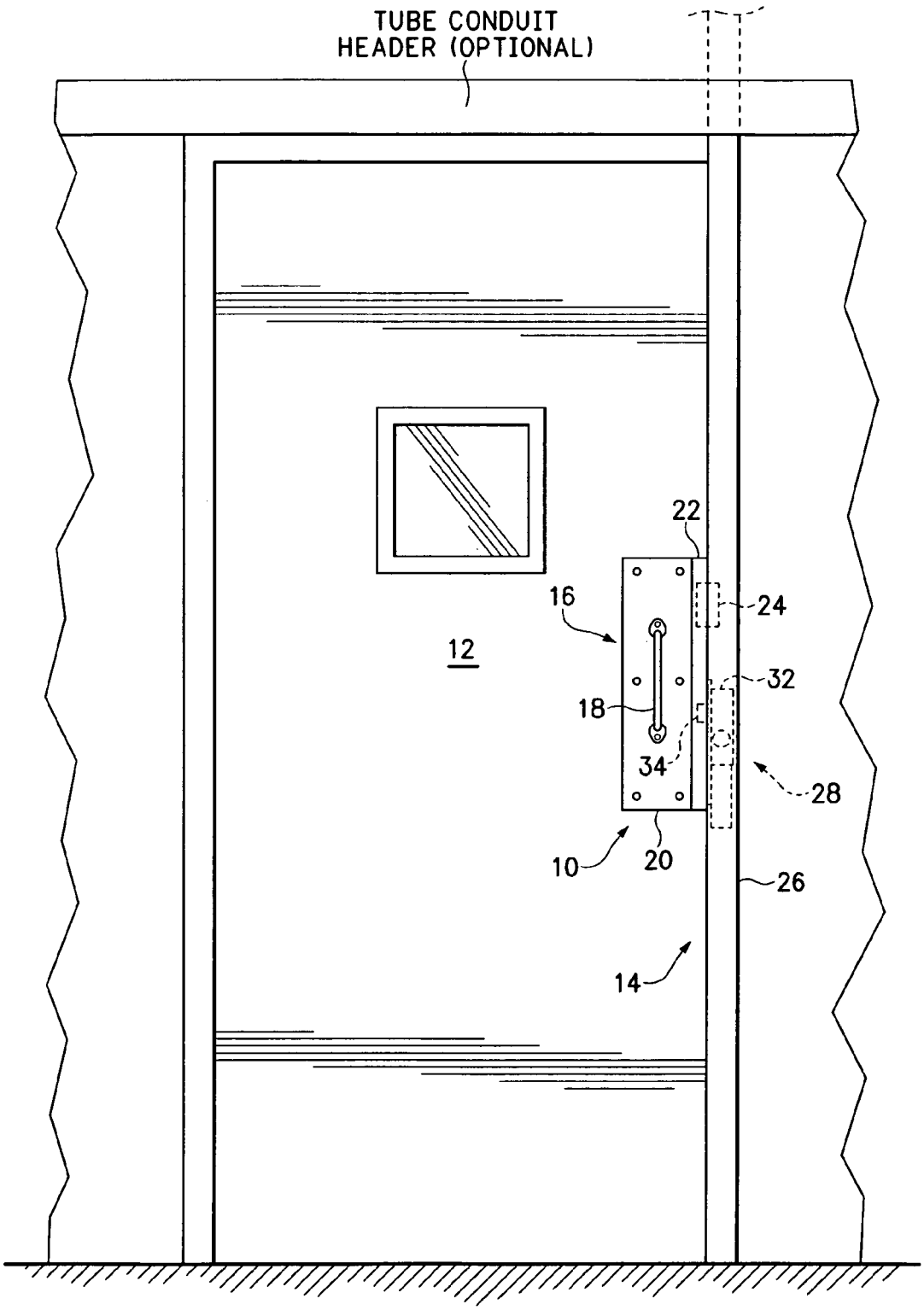
FIG. 1 is a front elevation of a door equipped with a door lock and position indicator mechanism in accordance with one embodiment of the invention.

FIG. 1 is a front elevation of the invented door lock mechanism 10 installed or retrofitted on a left-side hinged metal cell door 12 (those of skill in the art will appreciate that a right-side or left-handed door installation would simply be a mirror image). Door 12 and its wall and frame 14 will be understood to be conventional, and will not be described in detail herein. Suffice it to say that door 12 of conventional manual key lock manufacture has had all of its old manual key lock mechanism removed from both the original door 12 and from the original and typically integral door strike wall and frame 14 (refer briefly to FIGS. 3 and 4).

Door lock mechanism 10 includes a retrofit pull handle assembly 16 including a detention wire pull 18 and a door-mounted steel face plate receiver 20, the wire pull securely mounted on the face plate. Face plate 20 includes a forward or outer hollow vertical column 22 preferably integrally formed therewith for mounting therein a first component of a magnetic reed switch door position indicator (DPS) mechanism 24, the column including a hollow recess and an aperture for securely receiving therein a catch extendable from an auxiliary door strike jamb or riser 26.

Door lock mechanism 10 further includes a second component of the magnetic reed switch DPS mechanism 24, mounted within the hollow interior of auxiliary door strike jamb 26 securely aligned with the first component thereof, as shown. Those of skill in the art will appreciate that the first and second components of magnetic reed switch DPS mechanism 24 cooperate with one another to indicate whether door 12 is positioned relative to the door strike wall and frame 14 in or out of sufficiently precise alignment to indicate that the door is unsecured of secured (open or closed), respectively. Those of skill also will appreciate that DPS mechanism 24 can be implemented in accordance with the invention in any suitable manner and with any suitable means not limited to the use of a magnetic reed switch. For example, an alternative electronic or mechanical proximity detection mechanism can be used, within the spirit and scope of the invention.

Door lock mechanism 10 further includes an electromechanical lock mechanism 28 that includes a catch-extension/retraction mechanism 32 including an extendable/retractable catch (tongue) 34 operated by a switch mechanism (not separately shown), the former mounted within the hollow interior of auxiliary door strike jamb 26 typically beneath or at a lower elevation than that of DPS mechanism 24, as shown and the latter extendable therefrom and retractable thereinto. Those of skill in the art will appreciate that catch-extension/retraction mechanism 32 can be operated remotely or manually opened (this latter being required in most jurisdictions by safety code. For example, an authorized staff person can operate mechanism 32 remotely from a guard station or, alternatively, a jail or prison guard can operate mechanism 32 by key while standing outside the jail or prison cell, as described above). The DPS mechanism 24 can be remotely interrogated to determine whether the door is secure as indicated by the door's position relative to the jail or prison cell's door strike jamb. (Typically, the DPS mechanism reports via input/output (I/O) signaling to a program logic controller (PLC) within a base detention monitoring system, although such forms no part of the present invention.)

Those of skill in the art will appreciate that auxiliary door strike jamb 26 is referred to herein as a riser because its contiguous, hollow, interior channel provides a conduit for one or more electrical wiring harnesses that supply electricity to or from the electromechanical components of the door's invented electromechanical lock door strike assembly and/or its door position indicator. Similarly, an opened/closed signal within DPS mechanism 24 can be powered by a similar wiring harness and signals conveyed therefrom up through riser 26 (which, as suggested in FIG. 1, can extend terminate at the ceiling or in a non-accessible space thereabove containing a junction box for power and signal feed/monitoring). Similarly, a wiring harness can be used to power the switch, relay, motor, receiver, and/or other mechanism(s) within electromechanical lock mechanism 28.

Thus the riser provides for the wiring of the invented institutional door locking assembly for a hardwired mode of operation. The lock remains operational under powered mode and fail-secure under un-powered mode or under power failure. Key operation of the lock in un-powered mode or in power failure will still operate the locking assembly.

Figure 2:
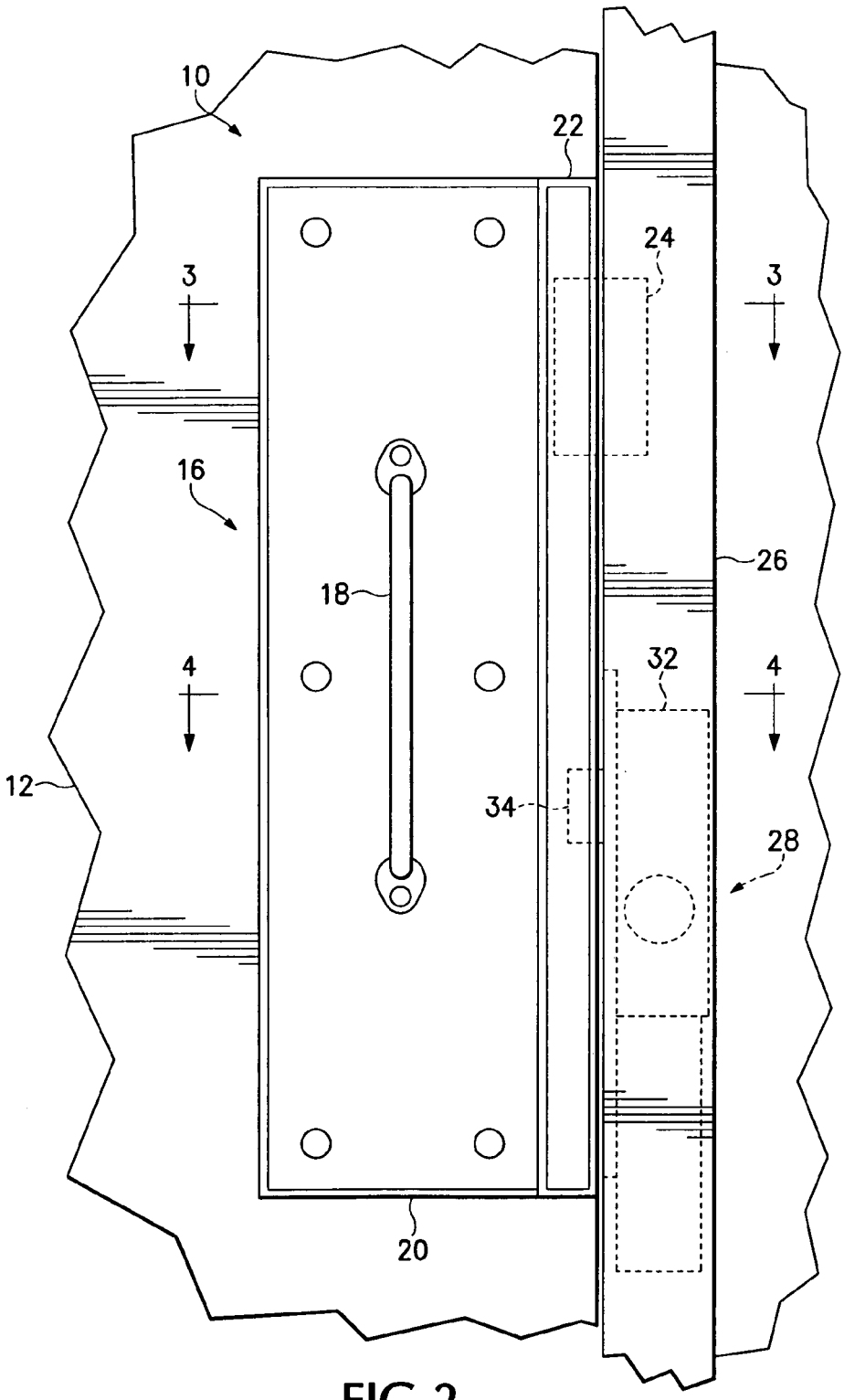
FIG. 2 is an enlarged detail of the lock and position indicator mechanism of FIG. 1.
Figure 3:
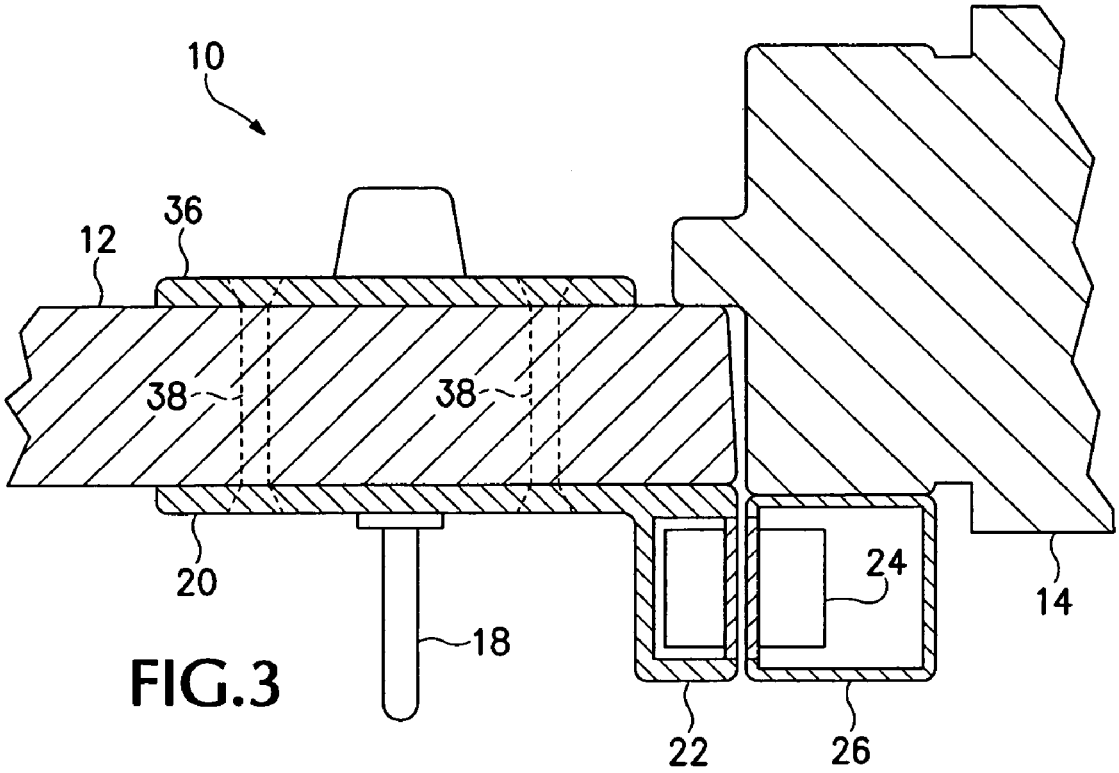
FIG. 3 is a sectional view taken along the lines 3-3 of FIG. 2.
Figure 4:
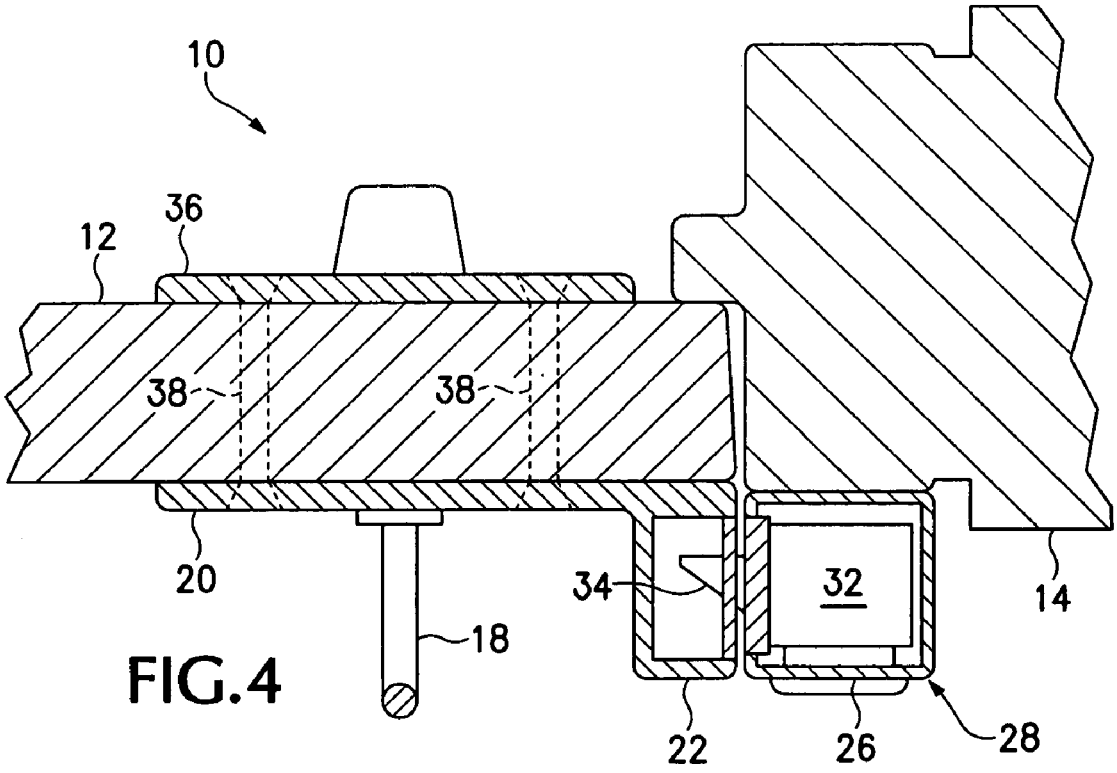
FIG. 4 is a sectional view taken along the lines 4-4 of FIG. 2.

Turning collectively now to FIGS. 2 through 4, further details of invented door lock mechanism 10 are described. Face plate 20 can be seen to be dimensioned in accordance with one embodiment of the invention as follows. The steel face plate is approximately ¼ inch (¼") thick and is approximately 19⅛" high by approximately 6" wide (including approximately 1" wide vertical column 22 preferably integrally formed therewith). Face plate 20 in accordance with one embodiment of the invention is cast but within the spirit and scope of the invention it may be made by any suitable process such as extrusion, die-stamping and/or die-cutting, etc. that is compatible with required security, durability, and overall integrity of the door lock mechanism.

Also in accordance with one embodiment of the invention, face plate 20 is backed by a backing plate 36 (refer to FIG. 3) of similar structure and dimension, but without the integrally formed vertical column 22. Thus, in accordance with one embodiment of the invention, face plate 20 and backing plate 36 are mounted using plural (e.g. six or other suitable number of) countersunk security fasteners 38 to one another on opposite surfaces of door 12. Those of skill in the art will appreciate that the security fasteners can take any suitable form, e.g. threaded collar/threaded post pairs, of any durable and uncompromise-able structure. For example, heavy gauge stainless steel countersink threaded male/female members the heads of which have pin torx bit patterns can be used. Those of skill will appreciate that similar or dissimilar but suitable fasteners and clips are utilized within auxiliary door jamb or riser 26 securely to mount and dress the electromechanical components and wiring harnesses.

Those of skill in the art will appreciate that the face and backing plates are substantially aligned with one another and are positioned to cover the region of the original door lock pocket bearing the manual key hole. In this installation manner, the retrofit of the original door 12 to be equipped with invented door lock mechanism 10 is substantially invisible from the interior and exterior of the jail or prison cell, and the original door's and jail or prison facility's aesthetic qualities are maintained while the facility's security and safety are enhanced.

As can be seen from FIGS. 3 and 4, door strike jamb or riser 26 can be made of 2"×2", 2"×2½", or 2"×3" fourteen gauge (14G) steel, extruded or otherwise manufactured in a preferably rectangular tubular form. Those of skill in the art will appreciate the high structural integrity and durability of such a structure, and also will appreciate that the hollow columnar region enclosed therein is configured securely to mount the second component of DPS mechanism 24 as well as the electromechanical lock mechanism 28 in proper horizontal alignment with their corresponding and cooperative features within vertical column 22. The riser in accordance with the invention is made to be compatible with one or more lock manufacturer's wiring harness configurations.

Those of skill in the art will appreciate that backing plate 36 can be provided without a handle or with a simple finger pull, as illustrated by a rounded trapezoid in FIGS. 3 and 4. Those of skill in the art also will appreciate that, in accordance with one embodiment of the invention, vertical column 22 and auxiliary door strike jamb or riser 26 are dimensioned depthwise such that their exterior surfaces are substantially flush with one another. It will be appreciated that within the spirit and scope of the invention, top and bottom horizontally extending auxiliary door frame members (shown in FIG. 1) can be added and mitered at the two right corners for smooth joinder with auxiliary door strike jamb or riser 26, thereby rendering the retrofitted door more useful as conduits for wiring harnesses as well as improving the aesthetic match and fit of the retrofitted door 12 and wall and frame 14.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

From the foregoing, those of skill in the art will appreciate that several advantages of the present invention include the following.

The present invention provides retrofit-ability into the large installed base of institutional doors of more secure and safe electromechanical locks. It provides simplicity and relatively low cost in such retrofit installations, with no modification to existing institutional walls, hardware or fixtures. It increases the ease of operation without compromising security or safety. Indeed, it enhances safety and security via added control and monitoring. Finally, it uses conventional electromechanical componentry and exiting doorjambs, frames and walls in such institutional settings.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Finally, those of skill in the art will appreciate that the invented method, system and apparatus described and illustrated herein may be implemented in software, firmware or hardware, or any suitable combination thereof. Preferably, the method system and apparatus are implemented in a combination of the three, for purposes of low cost and flexibility. Thus, those of skill in the art will appreciate that embodiments of the methods and system of the invention may be implemented by a computer or microprocessor process in which instructions are executed, the instructions being stored for execution on a computer-readable medium and being executed by any suitable instruction processor.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

I claim:

1. An institutional door lock mechanism comprising:

a hollow, elongated and columnar door strike jamb configured to attach to and extend along an exterior vertical surface of a door frame on the side thereof opposite one or more hinges of a door that is coupled with the door frame, the jamb including a catch-extension/retraction mechanism therein, the catch-extension/retraction mechanism including an alternately extendable and retractable catch;

a fronting plate configured for mounting to a planar exterior surface of the door adjacent the door strike jamb, the fronting plate having a rear surface and an opposing front surface, wherein the rear surface is configured as a planar expanse suitable to provide a close, contiguous planar-parallel contact with the correspondingly planar exterior surface of the door when the fronting plate is mounted thereto during use;

a wire pull handle securely attached to the front surface of the fronting plate and extending outwardly therefrom;

a columnar striker plate mechanism likewise securely attached to the fronting plate along an edge thereof and extending outwardly from the front surface thereof, the striker plate mechanism including an aperture formed into an opposite side of the striker plate mechanism relative to the wire pull handle, the aperture further being configured and presented to receive therein the alternately extendable and retractable catch when the catch is extended from the strike jamb during use; wherein the fronting plate, the handle, and the columnar striker plate mechanism are configured as a conjoined structure for unitary attachment to the planar surface of the door; and a remotely controllable switch mechanism operatively coupled with the catch-extension/retraction mechanism for operating the same to secure the door in a closed position relative to the frame.

2. The mechanism of claim 1 further comprising a proximity/alignment detection mechanism including a magnetic reed switch configured to indicate an open/lock position of the door relative the door frame.

3. The mechanism of claim 1, wherein the door strike jamb is configured as a vertical riser configured to house therein a vertically extending wiring harness for the catch-extension/retraction mechanism and for the proximity/alignment detection mechanism.

4. The mechanism of claim 2 further comprising:

a remote controller operatively coupled with the proximity/alignment detection mechanism, the remote controller configured to monitor the open/closed status of the door.

5. The mechanism of claim 1, wherein the catch-extension/retraction mechanism operates in a fail-safe lock-down mode of operation in the event of power interruption or failure.

6. The mechanism of claim 5, wherein the catch-extension/retraction mechanism includes a motor for extending/retracting the catch, the motor being operable by a securely coded manual key placed. adjacent the switch mechanism or within a keyway operatively coupled with the switch mechanism.

7. The mechanism of claim 1 further comprising:

a backing plate configured to be generally coextensive with the fronting plate when mounted on an interior surface of the door opposite the fronting plate during use.

8. The mechanism of claim 7, wherein the backing plate and the fronting plate are each configured with plural positionally-corresponding attachment features enabling the backing plate the fronting plate to be securely affixed to one another by security fasteners extending through the door.

9. The mechanism of claim 1, wherein the door strike jamb and the columnar striker plate mechanism are formed of steel in a rectangular tubular configuration.

10. The mechanism of claim 9, wherein exterior surfaces of the door strike jamb and the columnar striker plate mechanism facing away from the door frame and the door, respectively, are substantially flush with one another.

11. An institutional door lock system field retrofit mechanism comprising;

a hollow, elongated and columnar door strike jamb configured to be durably mounted to a vertical exterior surface of a door frame on the side thereof opposite a hinge of a door that is coupled with the door frame, the jamb including a catch-extension/retraction mechanism therein, the catch-extension/retraction mechanism including an alternately extendable and retractable catch selectively powered by an electronically controlled motor drive;

a fronting plate configured for mounting to a planar exterior surface of the door adjacent the door strike jamb, the fronting plate having a rear surface and an opposing front surface, wherein the rear surface is configured as a planar expanse suitable to provide a close, contiguous planar-parallel contact with the corresponding planar exterior surface of the door when the fronting plate is mounted thereto during use;

a wire pull handle securely attached to the front surface of the fronting plate and extending outwardly therefrom;

a columnar striker plate mechanism likewise securely attached to the fronting plate along an edge thereof and extending outwardly from the front surface thereof, the striker plate mechanism including an aperture formed into an opposite side of the striker plate mechanism relative to the wire pull handle, the aperture further being configured and presented to receive therein the alternately extendable and retractable catch when the catch is extended from the strike jamb during use, wherein the fronting plate, the handle, and the columnar striker plate mechanism are configured as a conjoined structure for unitary attachment to the planar exterior surface of the door;

a first component part of a proximity/alignment detection mechanism coupled with the columnar striker plate mechanism of the fronting plate;

a backing plate generally configured with a planar expanse suitable to provide a close, contiguous planar-parallel contact with a correspondingly planar interior surface of a door, the backing plate being coextensive with the fronting plate when the backing plate is mounted on an interior surface of the door opposite the fronting plate during use, the backing plate and the fronting plate being securely affixable to one another in place of an existing door plate/handle assembly by security fasteners extendable through the door;

a remotely controllable switch mechanism operatively coupled with the catch-extension/retraction mechanism for operating the same to secure the door in a closed position relative to the frame; and a second component part of the proximity/alignment detection mechanism durably coupled with the door strike jamb and configured to be positioned opposite the first component part thereof when the door strike jamb is mounted to an exterior surface of the door frame and the fronting plate is mounted to the exterior surface of the door during use, the first and second component parts of the proximity/alignment detection mechanism being configured to indicate remotely an open/lock position of the door relative the door frame.

12. The retrofit mechanism of claim 11, wherein the door strike jamb and second component part of the proximity/alignment detection mechanism are durably mounted to a door frame by welding.

13. The mechanism of claim 11, wherein the second component part of the proximity/alignment detection mechanism includes a columnar striker plate mechanism, and wherein the door strike jamb and the columnar striker plate mechanism are formed of steel in a rectangular tubular configuration.

14. The mechanism of claim 11, wherein outwardmost exterior surfaces of the door strike jamb and the columnar striker plate mechanism relative to the exterior surfaces of the door frame and door, respectively, are configured to be substantially flush with one another when mounted to the door frame and the door during use.

15. The mechanism of claim 11, wherein the catch-extension/retraction mechanism operates in a fail-safe lock-down mode of operation in the event of power interruption or failure.

16. The mechanism of claim 15, wherein the electronically controlled motor drive of the catch-extension/retraction mechanism is operable by a securely coded manual key placed adjacent the switch mechanism or within a keyway operatively coupled with the switch mechanism.

17. The mechanism of claim 11, wherein the door strike jamb is configured as a vertical riser configured to house therein a vertically extending wiring harness for the catch-extension/retraction mechanism and for the proximity/alignment detection mechanism.

18. The mechanism of claim 11, wherein the proximity/alignment detection mechanism includes a magnetic reed switch configured to indicate an open/lock position of the door relative the door frame.

19. An institutional door lock system field retrofit mechanism comprising:

a hollow elongated door strike jamb welded to a vertical exterior surface of an existing door frame on the side thereof opposite a hinge of a door that is coupled with the door frame, the jamb including a catch-extension/retraction mechanism therein, the catch-extension/retraction mechanism including an alternately extendable and retractable catch selectively powered by an electronically controlled motor drive, the catch-extension/retraction mechanism operating in a fail-safe lock-down mode of operation in the event of power interruption or failure, wherein the door strike jamb is configured as a durable-metal, square-tubular riser configured to house therein a vertically extending wiring harness for the catch-extension/retraction mechanism and for a component of a proximity/alignment detection mechanism;

a fronting plate mounted on the exterior surface of the door along an edge of the door adjacent the door strike jamb, the fronting plate having a front surface facing away from the door, and further being aligned with but not extending beyond an edge of the door adjacent the door strike jam;

a stationary pull handle being durably attached to an extending outwardly from the front surface of the fronting plate;

a columnar striker plate mechanism coupled to and extending alone an edge of the fronting plate, the striker plate mechanism including an aperture formed into an opposite side of the columnar striker plate mechanism relative to the handle, wherein the aperture is configured to receive therein the alternately extendable and retractable catch when the door is closed;

a first component part of a proximity/alignment detection mechanism coupled with the front surface of the fronting plate along the same edge thereof as the striker plate mechanism;

a backing plate mounted to and extending along an interior surface of the door opposite and generally coextensive with the fronting plate, and wherein the backing plate and the fronting plate are securely affixed to one another by security fasteners extendable through the door, and wherein one or both of the backing plate and the fronting plate cover openings remaining in the door from removal of previously existing door handle or door lock components;

a remotely controllable switch mechanism operatively coupled with the catch-extension/retraction mechanism for operating the same to secure the door in a closed position relative to the frame; and a second component part of the proximity/alignment detection mechanism coupled to the door frame opposite the first component part thereof, the first and second component parts of the proximity/alignment detection mechanism configured to indicate remotely an open/lock position of the door relative to the door frame.

* * * * *

UNITED STATES PATENT AND TRADEMARK OFFICE

CERTIFICATE OF CORRECTION

PATENT NO. : 8,381,558 B2
APPLICATION NO. : 12/080740
DATED : February 26, 2013
INVENTOR(S) : Peter Alef It is certified that error appears in the above-identified patent and that said Letters Patent is hereby corrected as shown below:

In the Claims:

Column 8:
at lines 22-23, replace "a stationary pull handle being durably attached to an extending" with --a stationary pull handle being durably attached to and extending--.

Column 8:
at lines 26-27, replace "a columnar striker plate mechanism coupled to and extending alone an edge of the fronting plate, the striker plate" with --a columnar striker plate mechanism coupled to and extending along an edge of the fronting plate, the striker plate--.

Signed and Sealed this
Twenty-third Day of April, 2013

Teresa Stanek Rea
*Acting Director of the United States Patent and Trademark Office*